US008107834B2

(12) United States Patent
Izumi et al.

(10) Patent No.: US 8,107,834 B2
(45) Date of Patent: Jan. 31, 2012

(54) IMAGE FORMING APPARATUS AND CONTROL METHOD FOR THE SAME

(75) Inventors: Takao Izumi, Kanagawa-ken (JP); Masato Ogasawara, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 1130 days.

(21) Appl. No.: 11/737,279

(22) Filed: Apr. 19, 2007

(65) Prior Publication Data

US 2007/0248369 A1 Oct. 25, 2007

(30) Foreign Application Priority Data

Apr. 19, 2006 (JP) ..... 2006-115380

(51) Int. Cl.
*G03G 15/00* (2006.01)

(52) U.S. Cl. ..... 399/44; 399/316; 399/301

(58) Field of Classification Search ..... 399/301, 399/316

See application file for complete search history.

(56) References Cited

U.S. PATENT DOCUMENTS 5,621,504 A * 4/1997 Wakamatsu et al. ..... 399/1
5,822,651 A * 10/1998 Yim et al. ..... 399/66
5,887,220 A * 3/1999 Nagaoka ..... 399/46

FOREIGN PATENT DOCUMENTS

JP 02-264278 10/1990
JP 2002-278307 9/2002

* cited by examiner

*Primary Examiner* — David Gray
*Assistant Examiner* — Roy Y Yi
(74) *Attorney, Agent, or Firm* — Turocy & Watson, LLP

(57) ABSTRACT

An image forming apparatus that transfers a toner image from includes a transfer belt to a sheet via to carry a toner image, a transfer roller. The image forming apparatus transfers the toner image by applying a transfer bias voltage to either the transfer roller or to make contact with the transfer belt to transfer the toner image onto a sheet from the transfer belt, an opposite roller facing the transfer roller across the transfer belt. The transfer bias voltage is decided by adding a transfer roller correction voltage, based on a voltage detected by a voltage detection unit when a predetermined current is applied to either the transfer roller or the opposite roller by a current application unit when no sheet is present in a transfer position, and a sheet correction voltage, based on a sheet kind and an intra-apparatus humidity.

15 Claims, 7 Drawing Sheets

| THIN PAPER | | RECYCLE PAPER | | ORDINARY SHEET | | HEAVY PAPER 1 | | HEAVY PAPER 2 | | SPECIAL SHEET 1 | | SPECIAL SHEET 2 | | OHP |
|---|---|---|---|---|---|---|---|---|---|---|---|---|---|---|
| FRONT | BACK | FRONT | BACK | FRONT | BACK | FRONT | BACK | FRONT | BACK | FRONT | BACK | FRONT | BACK | FRONT |

60a

| INTRA-APPARATUS HUMIDITY (%) | SHEET CORRECTION VOLTAGE (V) |
|---|---|
| 20 | 1100 |
| 35 | 800 |
| 50 | 600 |
| 60 | 570 |
| 70 | 540 |
| 85 | 500 |

60b

| INTRA-APPARATUS HUMIDITY (%) | SHEET CORRECTION VOLTAGE (V) |
|---|---|
| 20 | 1200 |
| 35 | 900 |
| 50 | 700 |
| 60 | 670 |
| 70 | 640 |
| 85 | 600 |

60c

| INTRA-APPARATUS HUMIDITY (%) | SHEET CORRECTION VOLTAGE (V) |
|---|---|
| 20 | 1000 |
| 35 | 700 |
| 50 | 500 |
| 60 | 470 |
| 70 | 440 |
| 85 | 400 |

60

IMAGE FORMING APPARATUS AND CONTROL METHOD FOR THE SAME

CROSS-REFERENCE TO RELATED APPLICATION

This application is based upon and claims the benefit of priority from the prior Japanese Patent Application No. 2006-115380 filed on Apr. 19, 2006, the entire contents of which are incorporated herein by reference.

BACKGROUND

1. Field of the Invention

The present invention relates to an image forming apparatus and a control method for the image forming apparatus.

2. Description of the Related Art

In an image forming apparatus such as a copier and a color printer, sheets and OHP sheets pass between an image carrying member and a transfer means and a toner image on the image carrying member is transferred onto the sheets. To execute efficient transfer at time of the transfer, a method for applying a transfer bias voltage to a transfer means is known. Depending on the difference in the method for applying the transfer bias voltage to the transfer means, the constant-voltage control method and constant-current control method are known.

The constant-voltage control method keeps the voltage to be applied to the transfer means as a transfer bias voltage at a constant voltage. In this case, the voltage applied to the transfer means is kept constant, so that when the resistance of the transfer means increases, the current flowing through the transfer means is reduced. Namely, even if the transfer can be executed appropriately in an environment at normal temperature and normal humidity, when the resistances of sheets, the transfer member, and image carrying member increase in an environment at low temperature and low humidity, a necessary transfer current cannot be obtained and defective transfer may be caused.

The constant-current control method keeps the transfer current flowing through the transfer means constant. By use of the constant-current control method, an appropriate transfer can be executed independently of the environment of temperature and humidity. However, even if the transfer is executed under the constant-current control, when the width of sheets is narrower than the width of the transfer means, the transfer means directly makes contact with the image carrying member, so that large currents flow on the contact part, thus a necessary current cannot be obtained on the sheets, and defective transfer is caused.

Therefore, as disclosed in Japanese Patent Application 2-264278, a control method in combination of the constant-voltage control with the constant-current control is proposed such that the transfer belt is in contact with the transfer means when there are no sheets P, and a constant current is applied to the transfer means, and the voltage generated in the transfer roller is assumed as V1, and when actually transferring on sheets, V1 is multiplied by a certain coefficient R, and the constant-voltage control is executed at a voltage of V2 (=RV1) higher than V1.

Further, as disclosed in Japanese Patent Application 2002-278307, the art for executing control for changing the transfer bias voltage depending on the intra-apparatus humidity, the sheet kind, and the count for printing when both sides of each sheet are printed or both sides are printed several times is proposed.

However, the difference between V1 and V2 in the aforementioned Japanese Patent Application 2-264278 is the difference in the transfer bias voltage generated by the resistances of sheets and toner and the value is changed widely depending on the environment of the sheet kind and intra-apparatus humidity. Therefore, when V2 is decided by multiplying V1 by a certain coefficient R, it may not be said always that only by multiplying V1 by a uniform constant R, an appropriate transfer bias voltage can be applied.

Further, in the aforementioned Japanese Patent Application 2002-278307, the necessary transfer bias voltage is taken into account depending on the intra-apparatus temperature and humidity and sheet kind, though the transfer bias voltage is a theoretical value decided on the basis of a predetermined numerical formula and table. Therefore, the actually necessary transfer bias voltage may vary with the use history of the image forming apparatus and the quality of sheets used by a user.

SUMMARY

An object of the present invention is to provide an image forming apparatus capable of executing stable transfer and a control method for the same.

According to the embodiments of the present invention, an image forming apparatus is provided and the image forming apparatus is composed of an image carrying member for carrying a toner image, a transfer member for making contact with the image carrying member to transfer the toner image onto a sheet from the image carrying member, an opposite member facing the transfer member across the image carrying member, a current applying means for applying a predetermined current to the transfer member or opposite member when there is not the sheet at the transfer position, a voltage detecting means for detecting a voltage generated at the transfer position by applying the predetermined current to the transfer member or opposite member by the current applying means, a first calculating means for calculating a transfer member correction voltage on the basis of the voltage detected by the voltage detecting means, a sheet detecting means for detecting the kind of the sheet, a humidity detecting means for detecting the intra-apparatus humidity, a second calculating means for calculating a sheet correction voltage on the basis of the detected sheet kind and the detected intra-apparatus humidity, a transfer bias voltage deciding means for adding the transfer member correction voltage calculated by the first calculating means and the sheet correction voltage calculated by the second calculating means, thereby deciding the transfer bias voltage, and a transfer bias voltage applying means for applying the transfer bias voltage decided by the transfer bias voltage deciding means to either of the transfer member and the opposite member so as to transfer the toner image onto the sheet from the image carrying member.

According to the embodiments of the present invention, a control method for an image forming apparatus including an image carrying member for carrying a toner image, a transfer member in contact with the image carrying member to transfer the toner image onto a sheet from the image carrying member, and an opposite member facing the transfer member across the image carrying member is provided and the control method comprises the steps of applying a predetermined current to the transfer member or opposite member when there is not the sheet at the transfer position, detecting a voltage generated at the transfer position by applying the predetermined current to the transfer member or opposite member, calculating a transfer member correction voltage on the basis of the detected voltage, detecting the kind of the sheet, detecting the intra-apparatus humidity, calculating a sheet correction voltage on the basis of the detected sheet kind and the detected intra-apparatus humidity, adding the calculated transfer member correction voltage and the sheet correction voltage, thereby deciding a transfer bias voltage, and applying the decided transfer bias voltage to either of the transfer member and the opposite member so as to transfer the toner image onto the sheet from the image carrying member.

DETAILED DESCRIPTION OF THE EMBODIMENTS

Figure 1:
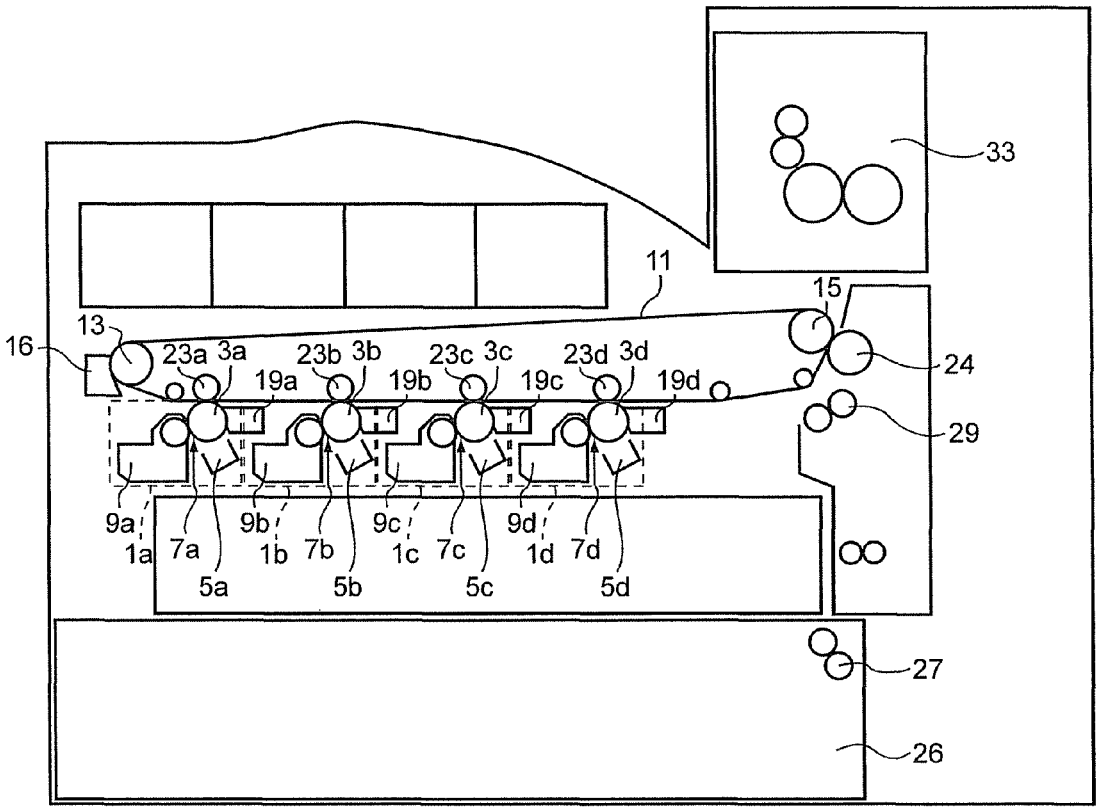
FIG. 1 is a cross sectional view of the image forming apparatus relating to Embodiment 1 of the present invention.

Hereinafter, the embodiments of the present invention will be explained with reference to the accompanying drawings.

Hereinafter, the embodiments of the color image forming apparatus of the present invention will be explained by referring to the drawings.

FIG. 1 is a cross sectional view of the image forming apparatus relating to Embodiment 1 of the present invention. In the image forming apparatus, process units 1*a*, 1*b*, 1*c* and 1*d* are installed. Each process unit has photosensitive drums 3*a*, 3*b*, 3*c* and 3*d* and these photosensitive drums form a toner image. The photosensitive drum 3*a* shown in FIG. 1 is a cylindrical rotator with a diameter of 30 mm and is installed rotatably in the process unit 1*a*.

Around the photosensitive drum 3*a*, a charger 5*a*, an exposure device 7*a*, a developing device 9*a*, a transfer roller 23*a*, an intermediate transfer belt 11 and a cleaner 19*a* are arranged in the rotational direction. The charger 5*a* is installed opposite to the surface of the photosensitive drum 3*a*. The charger 5*a* makes the photosensitive drum 3*a* uniformly negatively charged. On the downstream side of the charger 5*a* in the rotational direction, the exposure device 7*a* for exposing the charged photosensitive drum 3*a* and forming an electrostatic latent image is installed. Further, on the downstream side of the exposure device 7*a*, the developing device 9*a* storing yellow toner for reversely developing the electrostatic latent image formed by the exposure device 7*a* using the toner is installed.

Further, the intermediate transfer belt 11 which is an image carrying medium is installed so as to make contact with the photosensitive drum 3*a*. On the downstream side of the contact position of the photosensitive drum 3*a* with the intermediate transfer belt 11, the cleaner 19*a* is installed. The cleaner 19*a* eliminates the surface charge of the photosensitive drum 3*a* after transfer by uniform light irradiation and simultaneously removes the residual toner on the photosensitive drum 3*a*. By doing this, one cycle of image formation is completed and in the next image forming process, the charger 5*a* uniformly charges again the photosensitive drum 3*a*.

The process unit 1*a* is composed of the photosensitive drum 3*a*, charger 5*a*, developing device 9*a* and cleaner 19*a* and is installed removably in the image forming apparatus. The intermediate transfer belt 11, in the perpendicular direction (the depth direction in the drawing) to the conveying direction, has a depth (width) similar to the dimension of the photosensitive drum 3*a* in the depth direction. The intermediate transfer belt 11 is in an endless (seamless) shape and is carried on a driving roller 13 for rotating the belt at a predetermined speed and an opposed roller 15.

In this embodiment, the intermediate transfer belt 11 is made of polyimide with a thickness of 100 μm including uniformly diffused carbon. The intermediate transfer belt 11 has an electrical resistance of the order of $10^9$ Ωcm and indicates a semiconductive property. As a material of the intermediate transfer belt 11, any material indicating the semiconductive property of a volume resistance of the order of $10^8$ to $10^{11}$ Ωcm is acceptable. For example, in addition to polyimide including diffused carbon, polyethylene terephthalate, polycarbonate, polytetrafluoroethylene, or polyvinylidene fluoride including diffused conductive particles such as carbon are acceptable. Instead of conductive particles, a polymeric film the electric resistance of which is adjusted by composition adjustment may be used. Furthermore, such a polymeric film with an ion conductive material mixed or a rubber material such as silicon rubber or urethane rubber having a comparatively low electric resistance may be used.

In the conveying direction of the intermediate transfer belt 11, in addition to the process unit 1*a*, the process units 1*b*, 1*c* and 1*d* are arranged. The process units 1*b*, 1*c* and 1*d* have the similar constitution to that of the process unit 1*a*. Around the photosensitive drums 3*b*, 3*c* and 3*d*, chargers 5*b*, 5*c* and 5*d* are respectively installed. On the downstream sides of the chargers, exposure devices 7*b*, 7*c* and 7*d* are installed. On the downstream sides of the exposure devices, developing devices 9*b*, 9*c* and 9*d* and cleaners 19*b*, 19*c* and 19*d* are installed similarly to the constitution of the process unit 1*a*. What is different is toner stored in each developing device. The developing device 19*b* stores magenta toner (M toner), the developing device 19*c* cyan toner (C toner) and the developing device 19*d* black toner (K toner).

The intermediate transfer belt 11 makes contact with the respective photosensitive drums 3*a*, 3*b*, 3*c* and 3*d*. In the neighborhoods of the contact positions of the intermediate transfer belt 11 with the respective photosensitive drums, as a primary transfer means, the transfer rollers 23*a*, 23*b*, 23*c* and 23*d* are installed so as to face respectively the photosensitive drums. The transfer roller 23*a* is connected to a positive (+)

Figure 2:
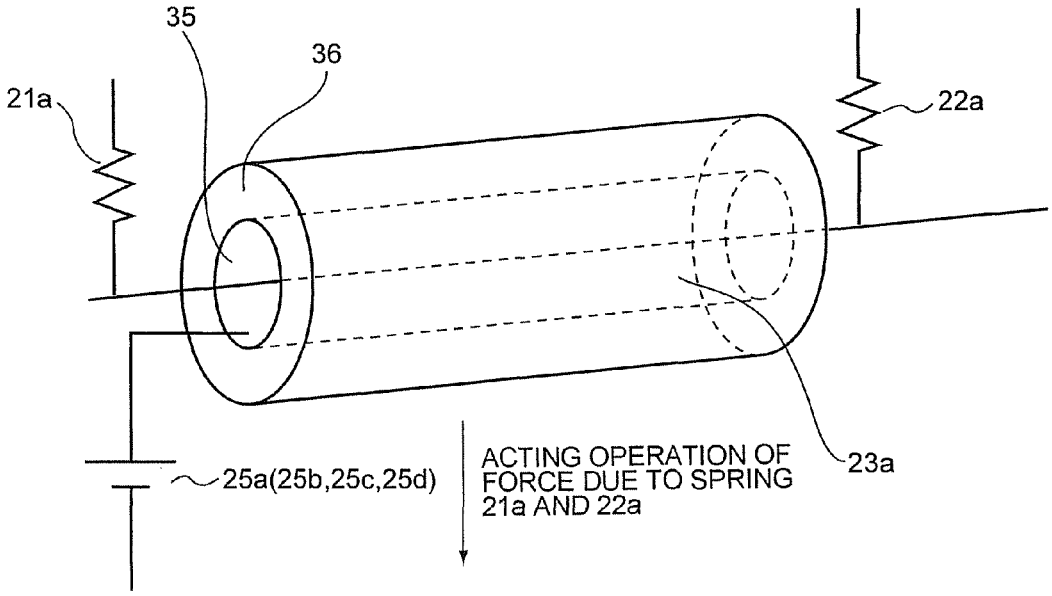
FIG. 2 is a schematic perspective view of the transfer roller relating to Embodiment 1 of the present invention.

DC power source 25*a* (FIG. 2). Similarly, the transfer rollers 23*b*, 23*c* and 23*d* are respectively connected to DC power sources 25*b*, 25*c* and 25*d*.

Further, in FIG. 1, on the lower part of the image forming unit, a sheet feed cassette 26 for storing sheets P is installed. In the image forming apparatus body, a pickup roller 27 for picking up the sheets P one by one from the sheet feed cassette 26 is installed. Further, the transfer means for transferring a toner image to the sheets P is composed of a secondary transfer roller 24 and opposed roller 15. In the neighborhood of the secondary transfer roller 24, an aligning roller pair 29 is installed rotatably. The aligning roller pair 29 feeds at predetermined timing the sheets P to the position where the secondary transfer roller 24 and intermediate transfer belt 11 face each other.

Further, there is a fixing device 33 for fixing a toner image on the sheets P and the sheets P fixed by the fixing device 33 are ejected to the sheet ejection section.

The color image forming operation of the image forming apparatus structured as mentioned above will be described below. When image formation start is instructed, the photosensitive drum 3*a* receives driving force from a driving mechanism not drawn and starts rotation. The charger 5*a* charges uniformly the photosensitive drum 3*a* at about −600 V. Thereafter, the exposure device 7*a* irradiates light according to the image to be recorded and forms an electrostatic latent image on the photosensitive drum 3*a*.

The developing device 9*a* stores a two-component developer composed of yellow (Y) toner and ferrite carrier particles, gives a developing bias voltage −380 V to a developing sleeve not drawn, and forms a developing electric field between the photosensitive drum 3*a* and itself. The Y toner is charged negatively due to friction with the ferrite carrier particles and reverse development of adhering to the region of the image portion potential (high potential portion) of the electrostatic latent image on the photosensitive drum 3*a* is executed.

Next, the developing device 9*b* develops the electrostatic latent image by a magenta developer and forms a magenta toner (M toner) image on the photosensitive drum 3*b*. At this time, the M toner has a volume average particle diameter of about 7 μm similarly to the Y toner and is charged negatively due to frictional charging with ferrite magnetic carrier particles with a volume average particle diameter of about 60 μm. The developing bias voltage is about −380 V similarly to that of the developing device 9*a* and reverse development is executed similarly to the Y toner.

In a transfer region Ta formed by the photosensitive drum 3*a*, intermediate transfer belt 11 and transfer roller 23*a*, a bias voltage of about +1000 V is applied to the transfer roller 23*a*. Between the transfer roller 23*a* and the photosensitive drum 3*a*, a transfer electric field is formed and the yellow image on the photosensitive drum 3*a* is transferred onto the intermediate transfer belt 11 according to the transfer electric field.

The transfer roller which is a primary transfer means will be furthermore explained by referring to FIG. 2. FIG. 2 is an illustration of the transfer roller relating to Embodiment 1 of the present invention. The transfer roller 23*a* is a conductive foamed urethane roller containing carbon conductively diffused. On a cored bar 35 with a diameter of 10 mm, a roller 36 with an outside diameter of 18 mm is formed. The electric resistance between the core bar 35 and the surface of the roller 36 is about $10^6\Omega$. To the core bar 35, the DC power source 25*a* is connected.

In the primary transfer means, the device to which the bias voltage is applied is not only the transfer roller but also may be a conductive brush, a conductive rubber blade, or a conductive sheet. The conductive sheet is a rubber material or a plastic film containing diffused carbon and may be a rubber material such as silicon rubber, urethane rubber, or ethylene propylene rubber or a plastic material such as polycarbonate. The volume resistance is desirably $10^5$ to $10^7$ Ωcm.

At both ends of the shaft of the transfer roller 23*a*, springs 21*a* and 22*a* as a force applying means are installed. By the springs 21*a* and 22*a*, the transfer roller 23*a* makes contact with the intermediate transfer belt 11 elastically in the perpendicular direction. The magnitude of the pressing force by the springs 21*a* and 22*a* installed on the transfer roller 23*a* is respectively taken as 600 gf. Here, the pressing force indicates the total of the pressing force 300 gf by the spring 21*a* and the pressing force 300 gf by the spring 22*a*.

The constitution of the transfer rollers 23*b*, 23*c* and 23*d* is the same as that of the transfer roller 23*a* and the constitution that they elastically make contact with the intermediate transfer belt 11 is also the same, so that for the constitution of the transfer rollers 23*b*, 23*c* and 23*d*, the explanation will be omitted.

Figure 3:
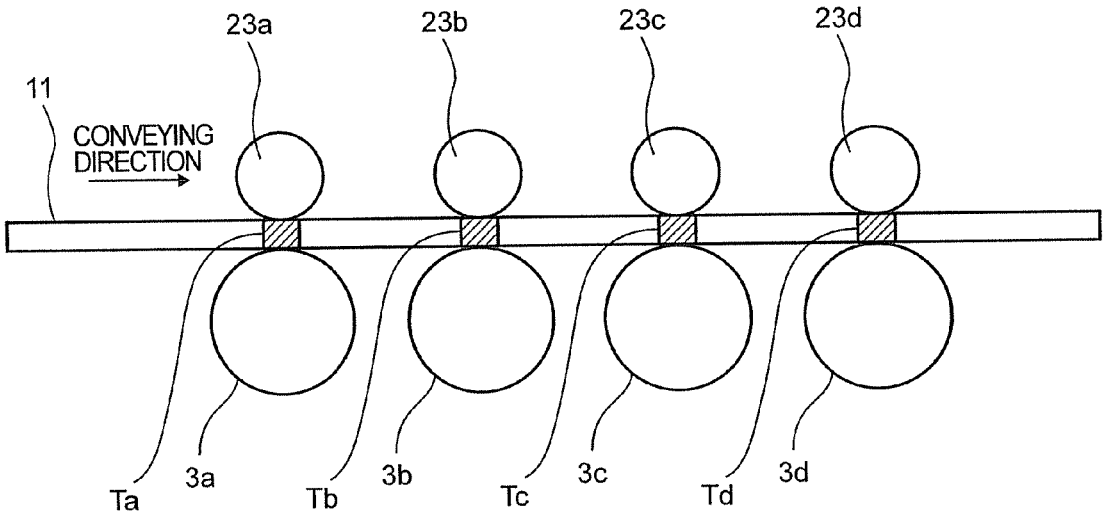
FIG. 3 is a front view of primary transfer relating to Embodiment 1 of the present invention.

Then, the primary transfer will be explained by referring to FIG. 3. FIG. 3 is an illustration for the primary transfer relating to Embodiment 1 of the present invention.

In the transfer region Ta, the image on the intermediate transfer belt 11 which is the Y (yellow) toner image transferred is conveyed toward a transfer region Tb. In the transfer region Tb, a bias voltage of about +1200 V is applied to the transfer roller 23*b* from the DC power source 25*b*, thus an M toner image is superimposed and transferred onto the Y toner image. In a transfer region Tc, a bias voltage of about +1400 V is applied to the transfer roller 23*c*, thereby a C toner image is superimposed on the already transferred toner image, and in a transfer region Td, a voltage of about +1600 V is applied to the transfer roller 23*d*, thereby a black toner image is superimposed on the already transferred toner image, thus these toner images are multiple-transferred sequentially.

On the other hand, the pickup roller 27 picks up the sheet P from sheet feed cassette 26 and the aligning roller pair 29 feeds the sheet P to the transfer means composed of the secondary transfer roller 24 and opposed roller 15.

Figure 4:
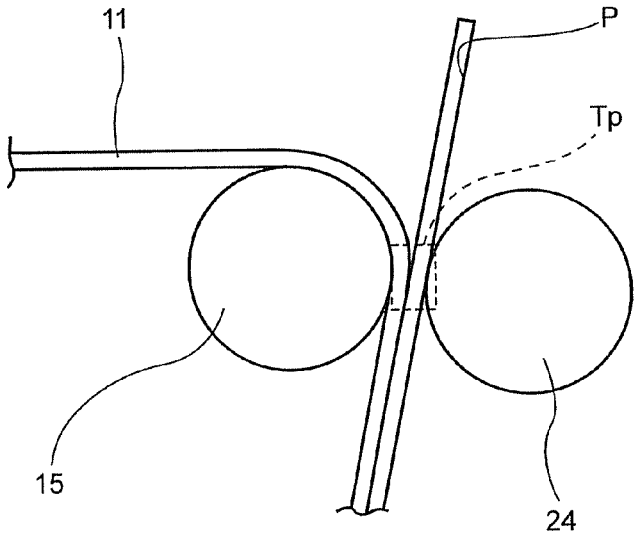
FIG. 4 is a front view of the transfer means relating to Embodiment 1 of the present invention.

Then, the transfer means will be explained by referring to FIG. 4. FIG. 4 is an illustration for the transfer means relating to Embodiment 1 of the present invention.

The transfer means has a function for transferring a toner image onto the sheet P and in this embodiment, it is composed of the secondary transfer roller 24 and opposed roller 15. When forming images, the transfer bias voltage is applied to the opposed roller 15 and a transfer electric field is formed between the secondary transfer roller 24 and the opposed roller 15 across the intermediate transfer belt 11. By this transfer electric field, the multi-color toner image on the intermediate transfer belt 11 is transferred to the sheet P in a batch. The toner images of the respective colors transferred in a batch like this are fixed on the sheet P by the fixing device 33. Further, this embodiment is not limited to the transfer method using the intermediate transfer belt 1 and also in a method for transferring directly to a sheet from the photosensitive drum, it is effective.

Figure 5:
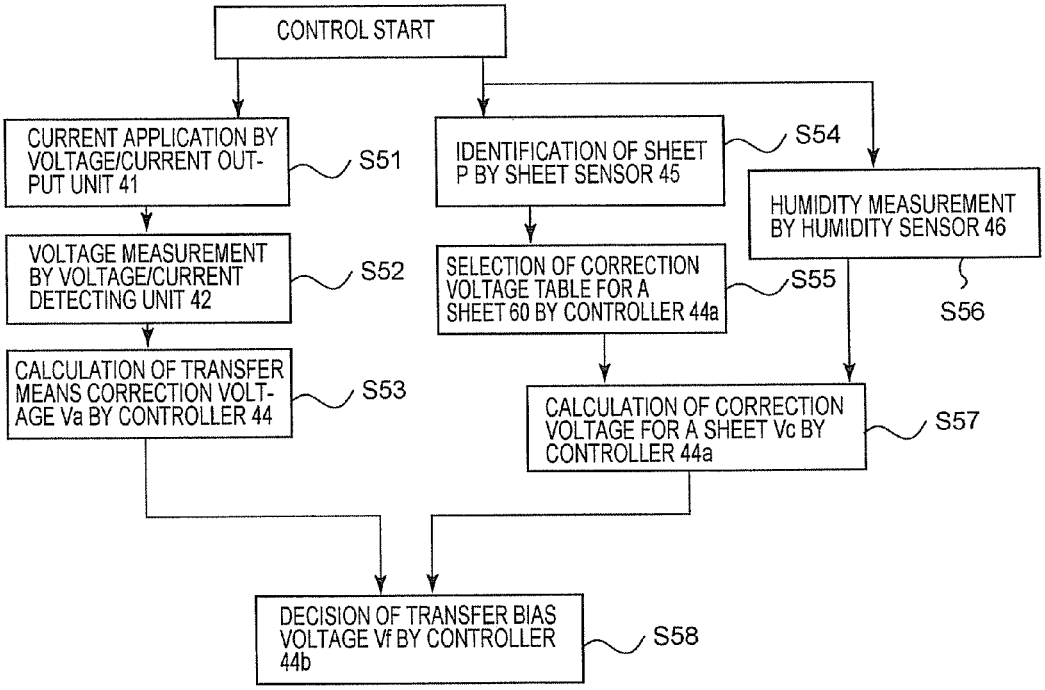
FIG. 5 is a flow chart concerning the correction of the transfer bias voltage of the image forming apparatus relating to Embodiment 1 of the present invention.

Next, the correction method for the transfer bias voltage in the image forming apparatus as aforementioned will be explained by referring to FIG. 5. FIG. 5 is a flow chart concerning the correction of the transfer bias voltage of the image forming apparatus relating to Embodiment 1 of the present invention.

There are two ways of correction of the transfer bias voltage available. One is a transfer means correction necessary due to change in the use history and resistance of the transfer means. Another one is a sheet correction necessary depending on change in the sheets P used for image formation and the intra-apparatus humidity. And, finally, these two corrections are put together, thus the transfer bias voltage is corrected.

Firstly, the transfer means correction will be explained. When the control is started, in the state that there are not sheets or sheets P such as OHP in a transfer region p, a voltage/current output unit 41 of a transformer 40 which is a current applying means applies a constant current of 30 μA to opposed roller 15 (S51). Further, the transformer 40, as a voltage detecting means, has a voltage/current detecting unit 42 for detecting a voltage and a current generated in the voltage/current output unit 41 in this case and can detect a voltage generated in the transfer means when the constant current of 30 μA is applied (S52).

Here, the detected voltage is outputted to a controller 44 of the image forming apparatus from a monitor output unit 43 of the transformer 40. And, the controller 44 which is a first calculating means, on the basis of this voltage, calculates a transfer means correction voltage Va so as to enable a predetermined transfer current to flow through the transfer means (S53). Next, the sheet correction will be explained. When the control is started, a sheet sensor 45 which is a sheet detecting means detects the kind of the sheets P selected by a user and the information is inputted to a controller 44*a* which is a second calculating means (S54). A correction voltage table for a sheet 60 is selected by the controller 44*a* (S55). Further, by a humidity sensor 46 of the image forming apparatus which is a humidity detecting means, the intra-humidity of the image forming apparatus is obtained and the intra-apparatus humidity is inputted to the controller 44*a* (S56). The controller 44*a*, on the basis of the correction table corresponding to the kind of the sheets P inputted and the intra-apparatus humidity, calculates a correction voltage Vc for a sheet (S57).

At this time, furthermore, the intra-apparatus temperature is detected by a temperature sensor 47 and is inputted to the controller 44*a*, thus a sheet correction in consideration of the intra-apparatus temperature can be executed and the controller 44*a* can calculate a fine sheet correction voltage. Furthermore, the sheet detecting means is not limited to the sheet sensor 45, and for example, the identifier installed in the cassette of the sheets P selected may be used or input information concerning the sheet kind selected by a user from the control panel of the image forming apparatus or a personal computer (PC) may be used.

When the transfer means correction voltage Va and correction voltage Vc for a sheet are calculated in this way, a controller 44*b*, as a transfer bias voltage deciding means, on the basis of the transfer means correction voltage Va and correction voltage Vc for a sheet, decides a final transfer bias voltage Vf (S58). In this embodiment, the final transfer bias voltage Vf is obtained as a sum of the transfer means correction voltage Va and correction voltage Vc for a sheet, though for example, the transfer bias voltage Vf may be obtained as $Vf=\partial Va+\beta Vc$ ($\partial$ and $\beta$ are respectively predetermined coefficients) or $Vf=f(Va)+f(Vc)$. ($f(Va)$ and $f(Vc)$ are respectively functions depending on Va and Vc.)

The transfer bias voltage Vf obtained as mentioned above is sent to the transformer 40 and the transformer 40 applies the transfer bias voltage Vf to the opposed roller 15 from the voltage/current output unit 41.

Figure 6:
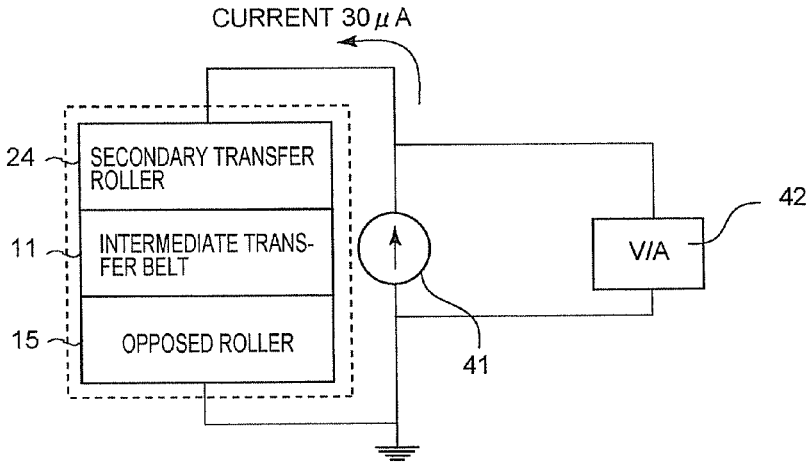
FIG. 6 is a schematic diagram of the transfer means correction voltage relating to Embodiment 1 of the present invention.

Then, the transfer means correction voltage will be explained more by referring to FIGS. 6 and 7. FIG. 6 is an illustration for the transfer means correction voltage relating to Embodiment 1 of the present invention.

When a constant current of 30 μA is applied to the opposed roller 15 by the transformer 40, a voltage generated between the opposed roller 15, intermediate transfer belt 11, and secondary transfer roller 24 is detected by the voltage/current detecting unit 42 and the voltage is inputted to the controller 44 of the image forming apparatus. And, by the program or table inputted to the controller 44 beforehand, an appropriate transfer means correction voltage Va based on the detected voltage is calculated.

Figures 7, 8:
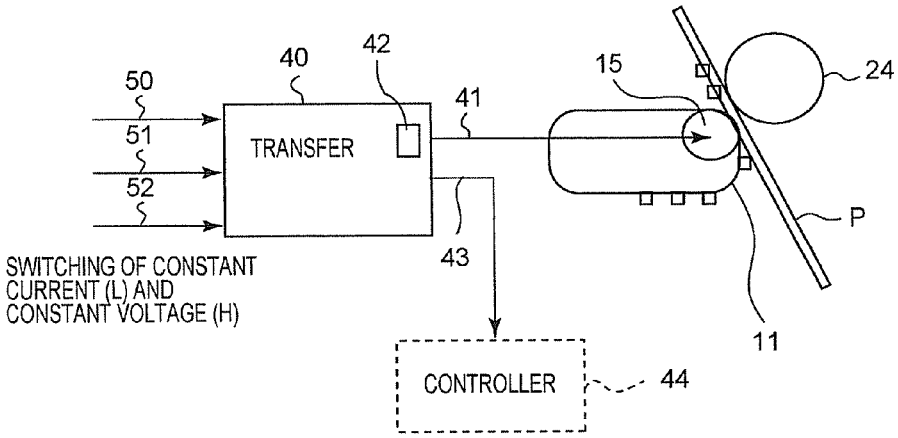
FIG. 7 is a schematic diagram of the transformer relating to Embodiment 1 of the present invention.
FIG. 8 is a sheet correction voltage table relating to Embodiment 1 of the present invention.

FIG. 7 is an illustration for the transformer relating to Embodiment 1 of the present invention. The transformer 40 includes three input units and two output units. The input units are an ON/OFF signal input unit 50 of the transformer 40, a control voltage signal input unit 51 for controlling the output level from the transformer, and a control switch signal input unit 52 for switching constant-current control and constant-voltage control. The output units are a voltage/current output unit 41 for outputting a bias voltage and a constant current and a monitor output unit 44 for outputting a voltage and a current generated at both ends of the voltage/current output unit to the controller 44.

When it is confirmed that the intermediate transfer belt 11 is driven and the secondary transfer roller 24 is in contact with the intermediate transfer belt 11, a signal is inputted to the ON/OFF signal input unit 50 and the transformer 40 is operated. Then, the output is switched to the constant-current output by the control switch signal input unit 52, and when it is set so as to obtain a constant current of 30 μA, the constant current of 30 μA is applied to the opposed roller 15 from the current/voltage output unit 41. And, a voltage generated in the current/voltage output unit 41 at that time, that is, a voltage generated between the opposed roller 15 and the second transfer roller 24 is detected by the voltage/current detecting unit 42 and this voltage (hereinafter, referred to as the monitor voltage) is outputted from the monitor output unit 43 to the controller 44 of the image forming apparatus. At this time, the monitor voltage, for stabilization of the constant current, is detected after a predetermined period of time. Although depending on the characteristic of the transformer 40, the time required from application of the constant current to detection of the monitor voltage is about 50 ms. Further, the time for detecting the monitor voltage is desirably the time required for the secondary transfer roller 24 to make a round or more, though the monitor voltage may be detected before the time required for the secondary transfer roller 24 to make a round. For example, assuming the diameter of the secondary transfer roller 24 as 28 mm, the processing speed as 150 mm/s, and the sampling cycle as 24 ms, the number of sampling times is about 24 and the mean value of those values is decided as a monitor voltage.

The relationship between the monitor voltage and the transfer means correction voltage Va is stored beforehand in the controller 44 as a function or a table and the transfer means correction voltage Va is calculated by this function or table.

Further, when measuring the transfer means correction voltage Va, the voltage/current output unit 41 applies the constant voltage instead of the constant current to the opposed roller 15. A method of detecting a current generated at that time by the voltage/current detecting unit 42, inputting it to the controller 44 of the image forming apparatus, and by the program or table inputted beforehand to the controller 44, calculating an appropriate transfer means correction voltage Va based on the detected voltage may be used.

Next, the sheet correction voltage will be explained by referring to FIG. 8.

FIG. 8 is an illustration for the sheet correction voltage relating to Embodiment 1 of the present invention. The correction voltage Vc for a sheet means a correction voltage calculated by the controller 44*a* which is the second calculating means and varies with the kind of the sheets P designated by a user and intra-apparatus humidity and temperature. The reason is that the resistance varies with the kind of the sheets P, thus the transfer voltage necessary for transfer is different. Furthermore, the reason is that the moisture contained in the sheets P designated by the user varies with the intra-apparatus humidity, and the resistance of the sheets P changes, and the transfer voltage necessary for transfer is different.

As shown in FIG. 8, correction voltage tables for a sheet 60*a* to 60*c* for the humidity at 6 points are stored in a storage unit 61 for each kind of the sheets P. The transfer material correction voltage at a certain humidity is calculated by the linear interpolation between each two points in the correction voltage table for a sheet 60. The correction voltage table for a sheet 60 is provided for each sheet P the kind of which for example, bond paper, ordinary sheet, heavy paper, thin paper and recycle paper can be set by a user from an external computer using a control panel of an image forming apparatus or a printer driver. For example, various tables such as the correction voltage table for a front face of A4 size ordinary sheet 60*a*, correction voltage table for a back face of A4 size ordinary sheet 60*b*, and correction voltage table for a front face of A3 size special sheet 60*c* are stored. When printing the second side of double sided print, the sheet P passes once through the fixing device, thus the moisture of the sheet P is removed and the resistance increases, so that even if the other conditions are the same, it is not preferable to use the correction voltage table for a sheet 60 which is the same as that for printing the first side. Therefore, for each sheet, the correction voltage table for a back face 60 may be provided. However, for sheets which are known not to execute double-sided print such as OHP or special sheets, there is no need to provide the correction voltage table for the second side 60.

Figure 9:
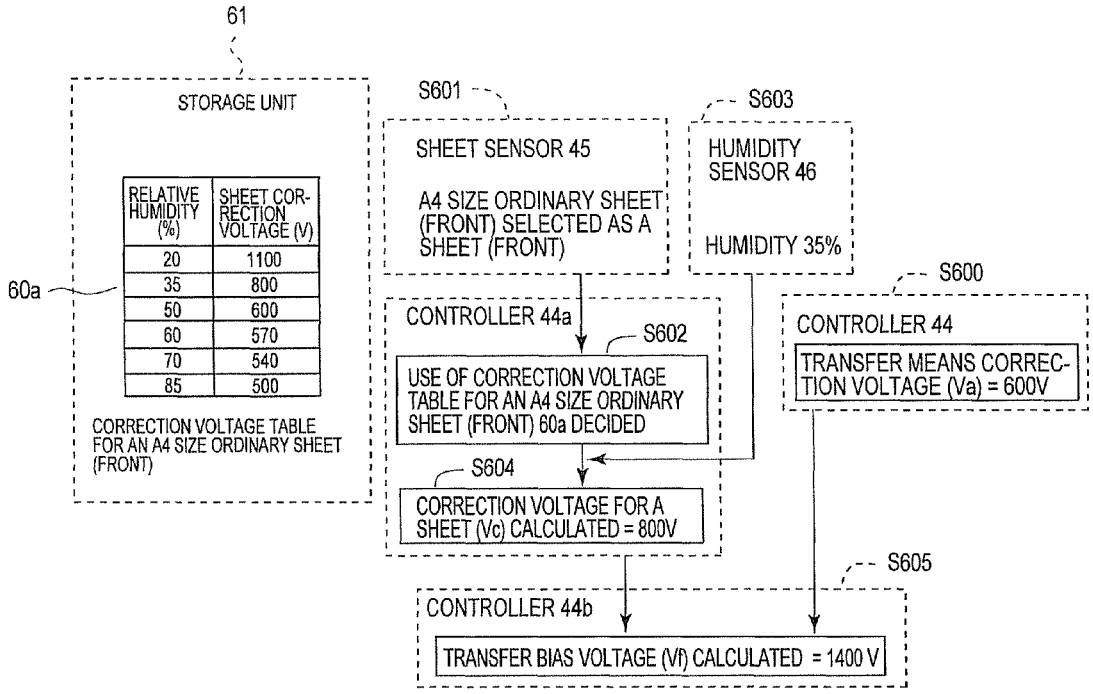
FIG. 9 is a table and a flow chart of the transfer bias voltage correction relating to Embodiment 1 of the present invention.

FIG. 9 is an illustration for the transfer bias voltage correction relating to Embodiment 1 of the present invention. When selecting the front face of A4 size ordinary sheet and forming an image by a user, the kind of the sheets P designated by the user is detected by the sheet sensor 45 (S601) and use of the correction voltage table for a front face of A4 size ordinary sheet 60*a* is decided (S602). Further, the intra-apparatus humidity is detected by the humidity sensor 46 (S603) and for example, when the intra-apparatus humidity is 35%, on the basis of the correction voltage table for a front face of A4 size ordinary sheet 60*a*, the correction voltage Vc for a sheet is calculated as 800 V (S604).

And, as mentioned above, the transfer bias voltage Vf based on the transfer means correction voltage Va and correction voltage Vc for a sheet which are calculated respectively by the controllers 44 and 44*a* is decided by the controller 44*b* (S605). Here, when the transfer means correction voltage Va of 600 V is obtained by the controller 44, the transfer bias voltage Vf is decided as 1,400 V from Vf=Va+Vb.

Decision of the transfer bias voltage is basically executed at start time of the print operation. However, for example, when one job is long as continuous printing of 500 sheets, the resistance of the transfer means may be changed halfway, so that during the job, the transfer bias voltage can be decided again. For example, a method for stopping once the printing operation during the print job and restarting the printing again, thereby deciding again the bias voltage is available. Or, a method for deciding again the bias voltage during the printing operation without stopping the printing operation is available.

Then, the second embodiment of the present invention will be explained by referring to FIGS. 10 and 11. Here, the explanation of the same parts as those of Embodiment 1 will be omitted, and the same numerals will be used for explanation, and only characteristic parts will be explained.

Figure 10:
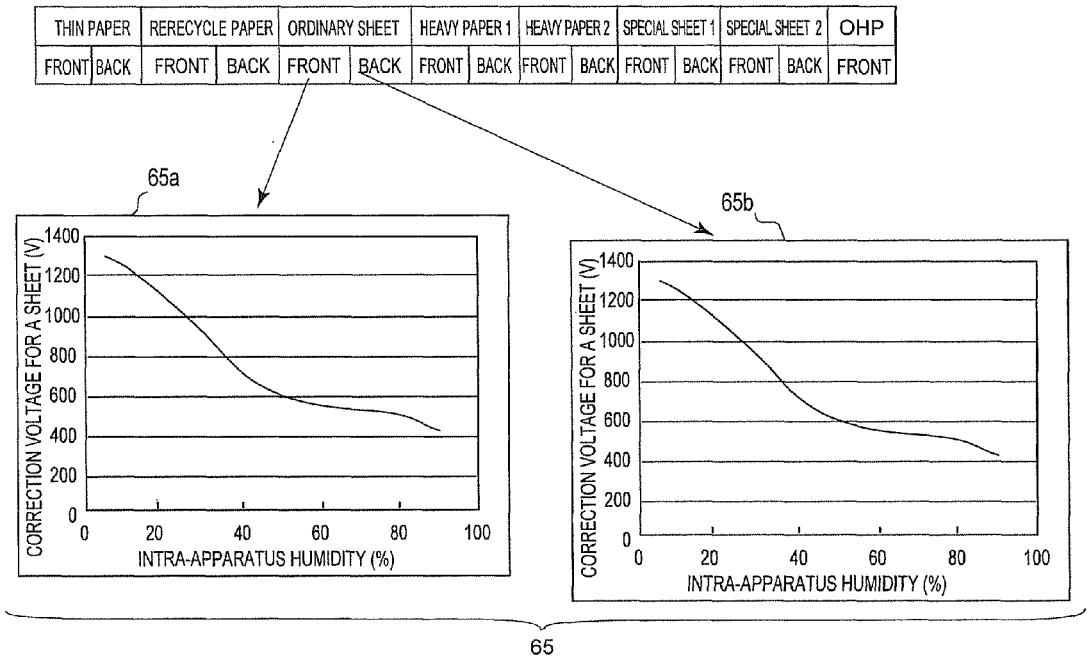
FIG. 10 is a graph of the sheet correction voltage relating to Embodiment 2 of the present invention.

FIG. 10 is an illustration for the sheet correction voltage relating to Embodiment 2 of the present invention. As shown in FIG. 10, a correction voltage function 65 for humidity is stored in the storage unit 61 for each kind of the sheets P. The sheet correction voltage for a certain humidity is calculated by the correction voltage function 65. The correction voltage function 65 is provided for each sheet P the kind of which for example, bond paper, ordinary sheet, heavy paper, thin paper, and recycle paper can be set by a user from an external computer using a control panel of an image forming apparatus or a printer driver and for example, and for example, functions such as a correction voltage function for a front face of A4 size ordinary sheet 65*a* and correction voltage function for a back face of A4 size ordinary sheet 65*b* are stored. When printing the second side of double sided print, the sheet P passes once through the fixing device, thus the moisture of the sheet P is removed and the resistance increases. Therefore, even if the other conditions are the same, it is not preferable to use the correction voltage function 65 which is the same as that for printing the first side. Therefore, for each sheet, the correction voltage function for a back face 65 may be provided. However, for sheets which are known not to execute double-sided print such as OHP or special sheets, there is no need to provide the table for the second side.

Figure 11:
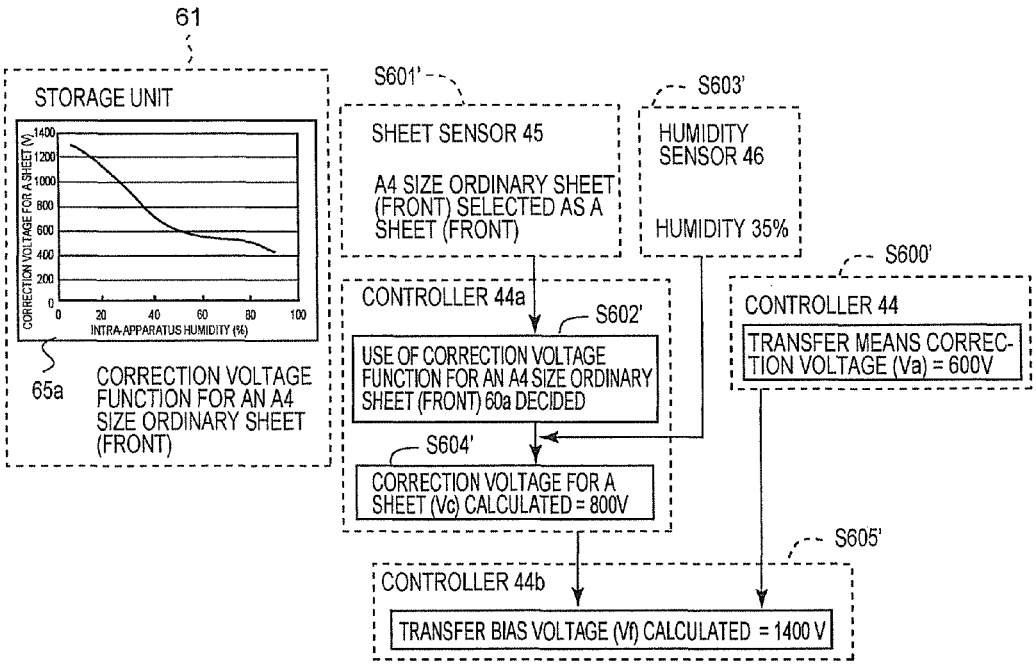
FIG. 11 is a graph and a flow chart of the transfer bias voltage correction relating to Embodiment 2 of the present invention.

FIG. 11 is an illustration for the transfer bias voltage correction relating to Embodiment 2 of the present invention. When selecting the front face of A4 size ordinary sheet and forming an image by a user, the kind of the sheets P designated by the user is detected by the sheet sensor 45 (S601') and use of the correction voltage function for a front face of A4 size ordinary sheet 65*a* is decided (S602'). Further, the intra-apparatus humidity is detected by the humidity sensor 46 (S603') and for example, when the intra-apparatus humidity is 35%, on the basis of the correction voltage function for a front face of A4 size ordinary sheet 65*a*, the correction voltage Vc for a sheet is calculated as 800 V (S604'). And, the transfer bias voltage Vf based on the transfer means correction voltage Va and correction voltage Vc for a sheet which are calculated respectively by the controllers 44 and 44*a* is decided by the controller 44*b* (S605').

Figure 12:
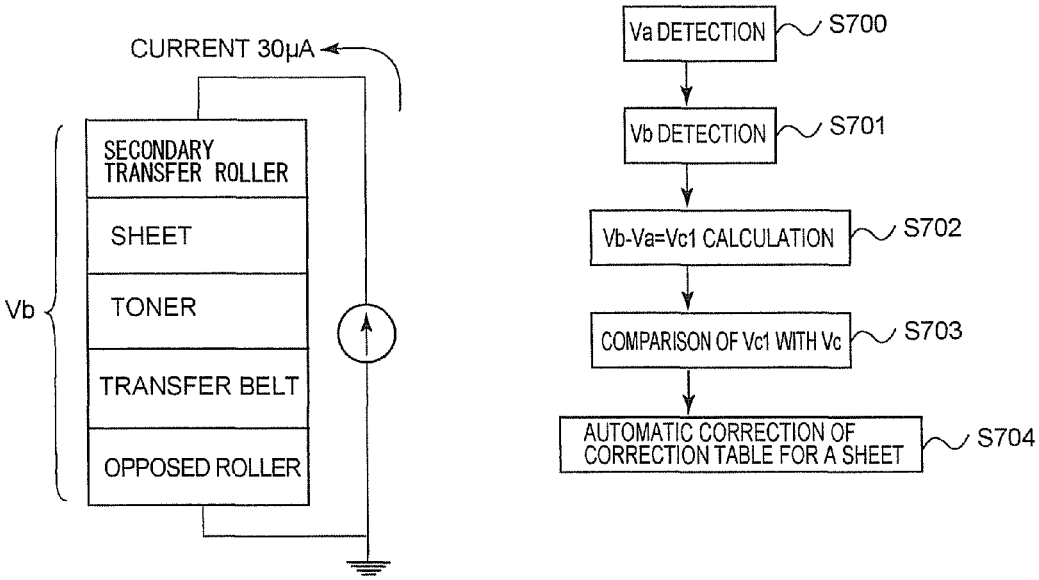
FIG. 12 is a schematic diagram and a flow chart of decision of the transfer bias voltage relating to Embodiment 3 of the present invention.

Then, the third embodiment of the present invention will be explained by referring to FIG. 12. FIG. 12 is an illustration for decision of the transfer bias voltage relating to Embodiment 3 of the present invention.

The correction voltage table for a sheet 60 storing beforehand the correction voltage Vc for a sheet is prepared on the basis of recommended paper. Therefore, even if it is just an ordinary sheet, there are various kinds available, so that the correction voltage table for a sheet 60 does not always respond finely to all sheets P. Therefore, to fit the transfer bias voltage to the sheets P actually used by a user, the following method can be used.

In this embodiment, a constant current of 30 μA is applied to the opposed roller 15 when there are no sheets P in the transfer region and on the basis of the monitor voltage detected at that time, the transfer means correction voltage Va is obtained (S700). Then, the constant current of 30 μA is applied to the opposed roller 15 when there are the sheets P in the transfer region, and the monitor voltage generated in the circuit composed of the opposed roller 15, sheets P, toner, transfer belt 11, and secondary transfer roller 24 is detected, thus the voltage Vb is obtained (S701). Here, when Vb−Va is calculated, a correction voltage Vc1 for a sheet caused by the actual sheets P and toner can be obtained (S702). Here, the correction voltage Vc for a sheet stored beforehand in the controller 44*a* and the correction voltage Vc1 for a sheet obtained here are compared (S703).

The table or function of the correction voltage Vc for a sheet stored beforehand in the controller 44*a* is prepared on the assumption of standard sheets P and is corrected by the correction voltage Vc1 for a sheet measured when there are sheets P and toner using actually it (S704). By repeating it, the correction voltage table or function for a sheet of the correction voltage Vc for a sheet stored beforehand is corrected to a correction voltage table or function for a sheet suited to the sheets P and toner which are used by a user.

Figure 13:
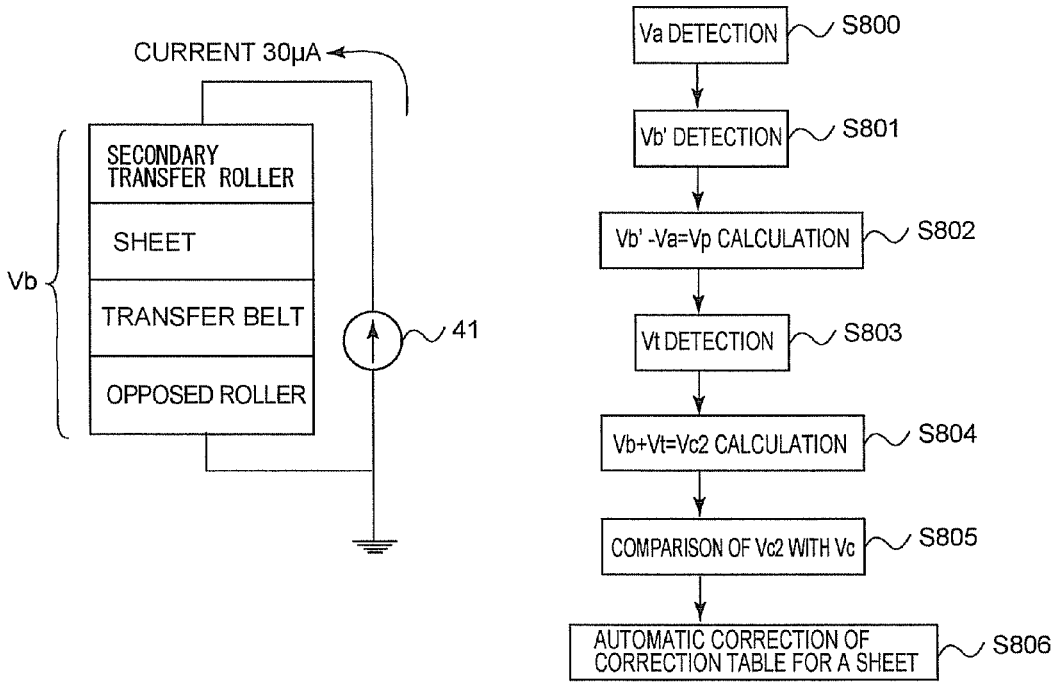
FIG. 13 is a schematic diagram and a flow chart of decision of the transfer bias voltage relating to Embodiment 4 of the present invention.

FIG. 13 is an illustration for decision of the transfer bias voltage relating to Embodiment 4 of the present invention. Firstly, a constant current of 30 μA is applied to the opposed roller 15 when there are no sheets P in the transfer region and on the basis of the monitor voltage detected at that time, the transfer means correction voltage Va is obtained (S800). Then, as shown in FIG. 13, the constant current of 30 μA is applied to the opposed roller 15 when there are only the sheets P in the transfer region and a monitor voltage Vb' detected at that time is obtained (S801). Here, the correction voltage only for the sheets P obtained from Vb'−Va is assumed as Vp (S802). On the other hand, a correction voltage Vt for toner based on the intra-apparatus humidity obtained from the humidity sensor 46 is calculated (S803). Here, a correction voltage Vc2 for a sheet caused by toner and sheets P is calculated as Vp+Vt, that is, Vb'−Va+Vt (S804), and this value and the correction voltage Vc for a sheet stored beforehand in the controller 44*a* are compared (S805), thus the correction voltage table for a sheet 60 can be corrected sequentially (S806).

According to the present invention, an image forming apparatus capable of executing stable transfer and a control method for the image forming apparatus can be provided.

What is claimed is:

1. An image forming apparatus comprising:

an image carrying member to carry a toner image; a transfer member to make contact with the image carrying member to transfer the toner image onto a sheet from the image carrying member;

an opposite member facing the transfer member across the image carrying member;

current applying means to apply a predetermined current to the transfer member or the opposite member when there is not the sheet at a transfer position;

voltage detecting means for detecting a voltage generated at the transfer position when there is not the sheet at the transfer position by applying the predetermined current to the transfer member or the opposite member by the current applying means;

first calculating means for calculating a transfer member correction voltage on the basis of the voltage detected by the voltage detecting means;

sheet detecting means for detecting a kind of the sheet;

humidity detecting means for detecting intra-apparatus humidity;

second calculating means for calculating a sheet correction voltage on the basis of the detected sheet kind and the detected intra-apparatus humidity;

transfer bias voltage deciding means for calculating a transfer bias voltage by adding the transfer member correction voltage calculated by the first calculating means and the sheet correction voltage calculated by the second calculating means; and transfer bias voltage applying means for applying the transfer bias voltage decided by the transfer bias voltage deciding means to either of the transfer member and the opposite member so as to transfer the toner image onto the sheet from the image carrying member.

2. The image forming apparatus according to claim 1 further comprising:

storing means for storing beforehand a correction function for correcting the sheet correction voltage on the basis of the sheet kind and the intra-apparatus humidity, wherein the second calculating means corrects the transfer bias voltage by using the correction function stored in the storing means.

3. The image forming apparatus according to claim 1 further comprising: storing means for storing beforehand a correction table for correcting the sheet correction voltage on the basis of the sheet kind and the intra-apparatus humidity, wherein the second calculating means corrects the transfer bias voltage by using the correction table stored in the storing means.

4. The image forming apparatus according to claim 1 further comprising:

second current applying means for applying a predetermined current to the transfer member or the opposite member when there exists the sheet at the transfer position;

second voltage detecting means for detecting a voltage generated at the transfer position when the current is applied by the second current applying means; and correcting means for subtracting the transfer member correction voltage from the voltage detected by the second voltage detecting means, thereby calculating the sheet correction voltage, and correcting a predetermined sheet correction voltage.

5. An image forming apparatus comprising:

an image carrying member to carry a toner image;

a transfer member to make contact with the image carrying member to transfer the toner image onto a sheet from the image carrying member;

an opposite member facing the transfer member across the image carrying member;

voltage applying means for applying a predetermined voltage to the transfer member or the opposite member when there is not the sheet at a transfer position;

current detecting means for detecting a current flowing to the transfer position by applying the predetermined voltage to the transfer member or the opposite member by the voltage applying means when there is not the sheet at the transfer position;

first calculating means for calculating a transfer member correction voltage on the basis of the current detected by the current detecting means;

sheet detecting means for detecting a kind of the sheet; humidity detecting means for detecting intra-apparatus humidity;

second calculating means for calculating a sheet correction voltage on the basis of the detected sheet kind and the detected intra-apparatus humidity;

transfer bias voltage deciding means for calculating the transfer bias voltage by adding the transfer member correction voltage calculated by the first calculating means and the sheet correction voltage calculated by the second calculating means; and transfer bias voltage applying means for applying the transfer bias voltage decided by the transfer bias voltage deciding means to either of the transfer member and the opposite member so as to transfer the toner image onto the sheet from the image carrying member.

6. The image forming apparatus according to claim 5 further comprising: storing means for storing beforehand a correction function for correcting the sheet correction voltage on the basis of the sheet kind and the intra-apparatus humidity, wherein the second calculating means corrects the transfer bias voltage by using the correction function stored in the storing means.

7. The image forming apparatus according to claim 5 further comprising: storing means for storing beforehand a correction table for correcting the sheet correction voltage on the basis of the sheet kind and the intra-apparatus humidity, wherein the second calculating means corrects the transfer bias voltage by using the correction table stored in the storing means.

8. An image forming apparatus comprising:

a transfer belt to carry a toner image;

a transfer roller to make contact with the transfer belt to transfer the toner image onto a sheet from the transfer belt;

an opposite roller facing the transfer roller across the transfer belt;

a current application unit to apply a predetermined current to the transfer roller or the opposite roller when there is not the sheet at a transfer position;

a voltage detection unit to detect a voltage generated at the transfer position by applying the predetermined current to the transfer roller or the opposite roller by the current application unit when there is not the sheet at the transfer position;

a sheet sensor to detect a kind of the sheet;

a humidity sensor to detect intra-apparatus humidity; and a transfer bias voltage application unit to calculate a transfer roller correction voltage on the basis of the voltage detected by the voltage detection unit, calculate a sheet correction voltage on the basis of the sheet kind detected by the sheet sensor and the intra-apparatus humidity detected by the humidity sensor, add the calculated transfer roller correction voltage and the sheet correction voltage, thereby decide a transfer bias voltage, and apply the decided transfer bias voltage to either of the transfer roller and the opposite roller so as to transfer the toner image onto the sheet from the transfer belt.

9. An image forming apparatus comprising:

a transfer belt to carry a toner image;

a transfer roller to make contact with the transfer belt to transfer the toner image onto a sheet from the transfer belt;

an opposite roller facing the transfer roller across the transfer belt;

a voltage application unit to apply a predetermined voltage to the transfer roller or the opposite roller when there is not the sheet at a transfer position;

a current detection unit to detect a current flowing to the transfer position when there is not the sheet at the transfer position by applying the predetermined voltage to the transfer roller or the opposite roller by the voltage application unit;

a sheet sensor to detect a kind of the sheet;

a humidity sensor to detect intra-apparatus humidity; and a transfer bias voltage application unit to calculate a transfer roller correction voltage on the basis of the current detected by the current detection unit, calculate a sheet correction voltage on the basis of the sheet kind detected by the sheet sensor and the intra-apparatus humidity detected by the humidity sensor, add the calculated transfer roller correction voltage and the sheet correction voltage, thereby decide a transfer bias voltage, and apply the decided transfer bias voltage to either of the transfer roller and the opposite roller so as to transfer the toner image onto the sheet from the transfer belt.

10. A control method for an image forming apparatus including an image carrying member to carry a toner image, a transfer member in contact with the image carrying member to transfer the toner image onto a sheet from the image carrying member, and an opposite member facing the transfer member across the image carrying member, the method comprising:

applying a predetermined current to the transfer member or the opposite member when there is not the sheet at a transfer position;

detecting a voltage generated at the transfer position by applying the predetermined current to the transfer member or the opposite member when there is not the sheet at the transfer position;

calculating a transfer member correction voltage on the basis of the detected voltage;

detecting a kind of the sheet;

detecting intra-apparatus humidity;

calculating a sheet correction voltage on the basis of the detected sheet kind and the detected intra-apparatus humidity;

deciding a transfer bias voltage by adding the calculated transfer member correction voltage and the sheet correction voltage; and applying the decided transfer bias voltage to either of the transfer member and the opposite member so as to transfer the toner image onto the sheet from the image carrying member.

11. The control method according to claim 10 further comprising:

storing beforehand a correction function for correcting the sheet correction voltage on the basis of the sheet kind and the intra-apparatus humidity; and correcting the transfer bias voltage by using the stored correction function.

12. The control method according to claim 10 further comprising:

storing beforehand a correction table for correcting the sheet correction voltage on the basis of the sheet kind and the intra-apparatus humidity; and correcting the transfer bias voltage by using the stored correction table.

13. A control method for an image forming apparatus including an image carrying member to carry a toner image, a transfer member in contact with the image carrying member to transfer the toner image onto a sheet from the image carrying member, and an opposite member facing the transfer member across the image carrying member, the method comprising:

applying a predetermined voltage to the transfer member or the opposite member when there is not the sheet at a transfer position;

detecting a current flowing to the transfer position by applying the predetermined voltage to the transfer member or the opposite member when there is not the sheet at the transfer position;

calculating a transfer member correction voltage on the basis of the detected current;

detecting a kind of the sheet;

detecting intra-apparatus humidity;

calculating a sheet correction voltage on the basis of the detected sheet kind and the detected intra-apparatus humidity;

deciding a transfer bias voltage by adding the calculated transfer member correction voltage and the sheet correction voltage; and applying the decided transfer bias voltage to either of the transfer member and the opposite member so as to transfer the toner image onto the sheet from the image carrying member.

14. The control method according to claim 13 further comprising:

storing beforehand a correction function for correcting the sheet correction voltage on the basis of the sheet kind and the intra-apparatus humidity; and correcting the transfer bias voltage by using the stored correction function.

15. The control method according to claim 13 further comprising:

storing beforehand a correction table for correcting the sheet correction voltage on the basis of the sheet kind and the intra-apparatus humidity; and correcting the transfer bias voltage by using the stored correction table.

* * * * *